United States Patent [19]

Allgaier et al.

[11] 4,232,717

[45] Nov. 11, 1980

[54] TENNIS BALL CAN FILLER

[75] Inventors: Joseph M. Allgaier, Chicago; Jack W. Richens, Naperville; Rajendra K. Leekha, Glendale Heights, all of Ill.

[73] Assignee: The Continental Group, Inc., New York, N.Y.

[21] Appl. No.: 972,157

[22] Filed: Dec. 21, 1978

[51] Int. Cl.[3] ..... B65B 1/04

[52] U.S. Cl. ..... 141/179; 141/183; 141/238; 221/266; 221/277; 222/368

[58] Field of Search ..... 141/129, 183–191, 141/238, 179; 222/368; 221/266, 277

[56] References Cited

U.S. PATENT DOCUMENTS

| | | | |
|---|---|---|---|
| 1,859,562 | 5/1932 | Huston | 222/368 |
| 3,631,903 | 1/1972 | Huggins | 141/238 |
| 4,004,620 | 1/1977 | Rosen | 141/179 |

FOREIGN PATENT DOCUMENTS

| | | | |
|---|---|---|---|
| 1511861 | 5/1966 | Fed. Rep. of Germany | 221/266 |

*Primary Examiner*—Houston S. Bell, Jr.
*Attorney, Agent, or Firm*—Charles E. Brown

[57] ABSTRACT

This relates to a filling apparatus for simultaneously filling plural containers, which apparatus includes a product supply, a dispenser and a conveyor system wherein plural containers are positioned beneath the dispenser and plural products are dispensed by the dispenser from the supply into the plural containers simultaneously. Most specifically, the apparatus includes a container positioner of the vane and screw type and the dispenser is in the form of a turret having a plurality of spaces in accordance with the number of containers to be simultaneously filled, the plurality of spaces being arranged in groups and disposed radially about the axis of the turret. Most particularly, the apparatus is intended for filling cans with tennis balls.

10 Claims, 10 Drawing Figures

TENNIS BALL CAN FILLER

This invention relates in general to new and useful improvements in filling apparatus, and most particularly to an apparatus for simultaneously filling a predetermined number of cans with tennis balls and the like.

In accordance with this invention, it is particularly intended to fill simultaneously a plurality of cans each with a plurality of tennis balls. In accordance with this invention, the cans are delivered and discharged by an endless chain or belt conveyor. There is a can positioner of the screw or vane type which engages the cans and serves to position the cans in alignment with a turret type ball dispenser. The dispenser has a plurality of groups of pockets arranged in radiating relation. The turret is indexed, together with the can positioner, so that when the preselected number of cans are in alignment with the turret, one group of pockets of the turret is in dispensing position while a diametrically opposite group of pockets is in alignment with the supply for refilling. Since the positioning means and the turret are simultaneously driven by the same indexing drive, the cans to be filled are momentarily positioned in alignment with the pockets of the turret for receiving the tennis balls therefrom and thus the filling operation is automatic and complete.

In the preferred embodiment of the invention, the turret has provided on opposite sides thereof vanes which rotate with the turret and extend transversely of the conveyor so as to position the cans to be filled. One vane is an inlet vane and controls the timing of movement of cans into underlying relation with respect to the turret, and the other vane is a discharge vane controlling the outflow of filled cans.

In another form of the invention, the cans are positioned relative to the turret by means of a screw type positioner which extends alongside the conveyor. The positioning screw is driven in timed relation with respect to the rotation of the turret although it is mounted independently of the turret.

Although the filling apparatus is particularly adapted to the filling of cans with tennis balls, it is to be understood that other types of containers may be filled with other products without departing from the scope of the invention.

With the above and other objects in view that will hereinafter appear, the nature of the invention will be more clearly understood by reference to the following detailed description, the appended claims, and the several views illustrated in the accompanying drawings.

IN THE DRAWINGS

Figure 2:
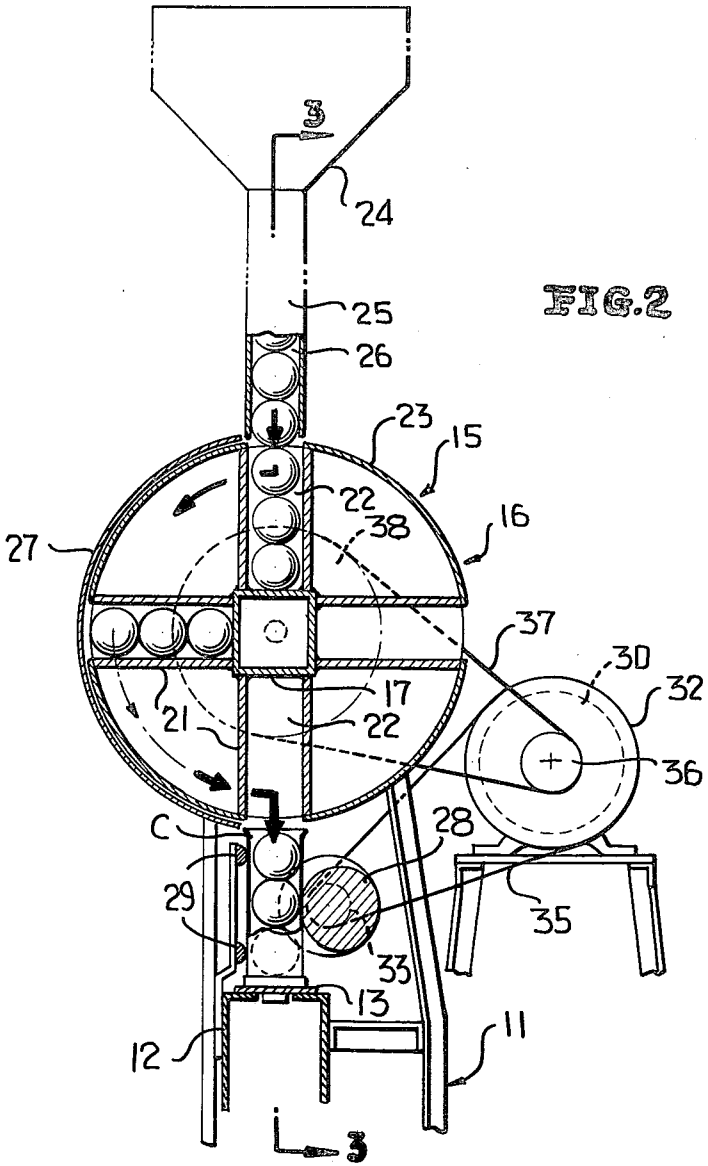
FIG. 2 is a vertical sectional view taken along the line 2—2 of FIG. 1 and shows the details of the dispenser in filling one can with three tennis balls while a diametrically opposite pocket of the dispenser is receiving a like number of tennis balls from a supply.

Referring now to the drawings in detail, it will be seen that one form of the filling apparatus is generally identified by the numeral 10 and includes a supporting framework generally identified by the numeral 11. The supporting framework 11 includes a bed 12 for an endless belt conveyor 13 which receives cans C in sequence along a predetermined path 14, the cans C being directed to the endless belt conveyor 13 from any desired supply source.

Carried by the framework 11 in overlying relation to the endless belt conveyor 13 is a dispenser 15. The dispenser 15 includes a turret 16 having a central hub portion 17 and stub axles 18 and 19.

Figure 4:
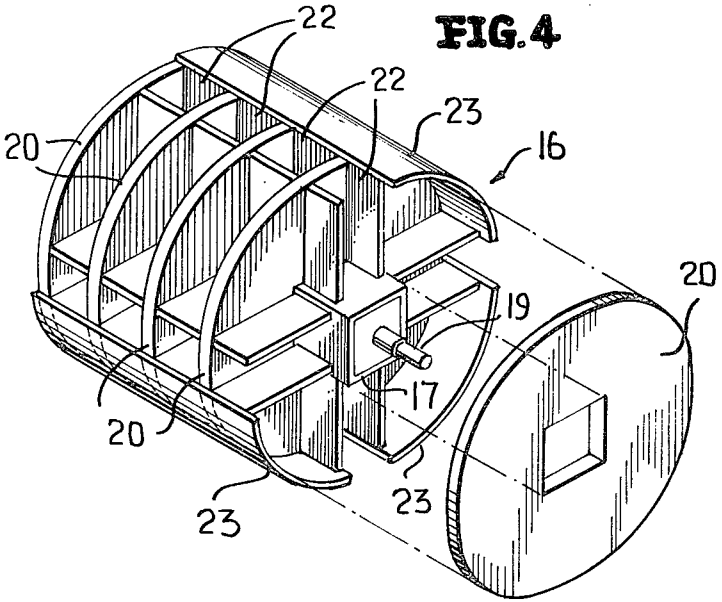
FIG. 4 is a perspective view with parts broken away of the turret-type dispenser utilized in accordance with this invention.
Figure 3:
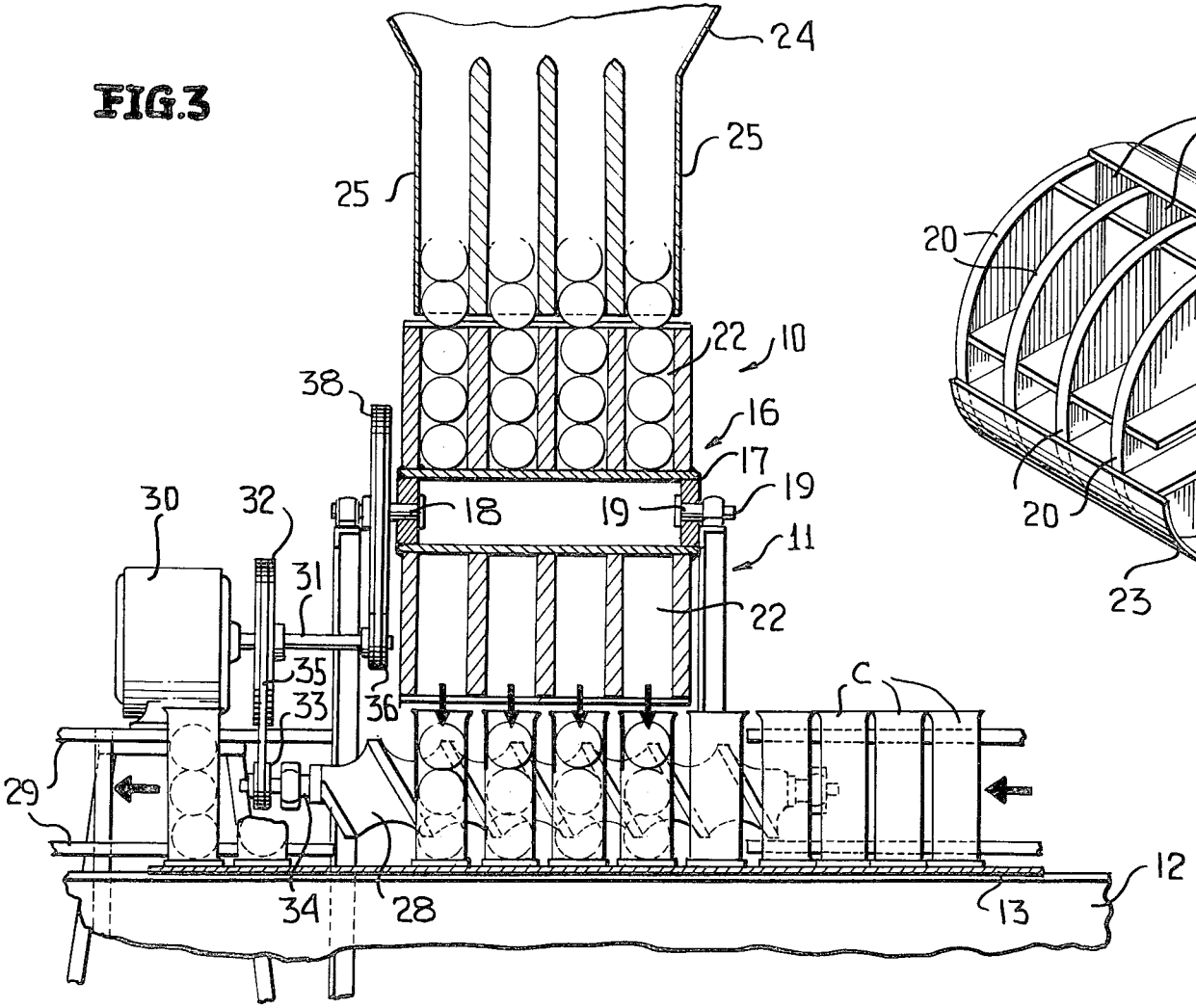
FIG. 3 is a longitudinal vertical sectional view taken along the line 3—3 of FIG. 2, and shows further the relationship of the cans being filled with the dispenser.
Figure 5:
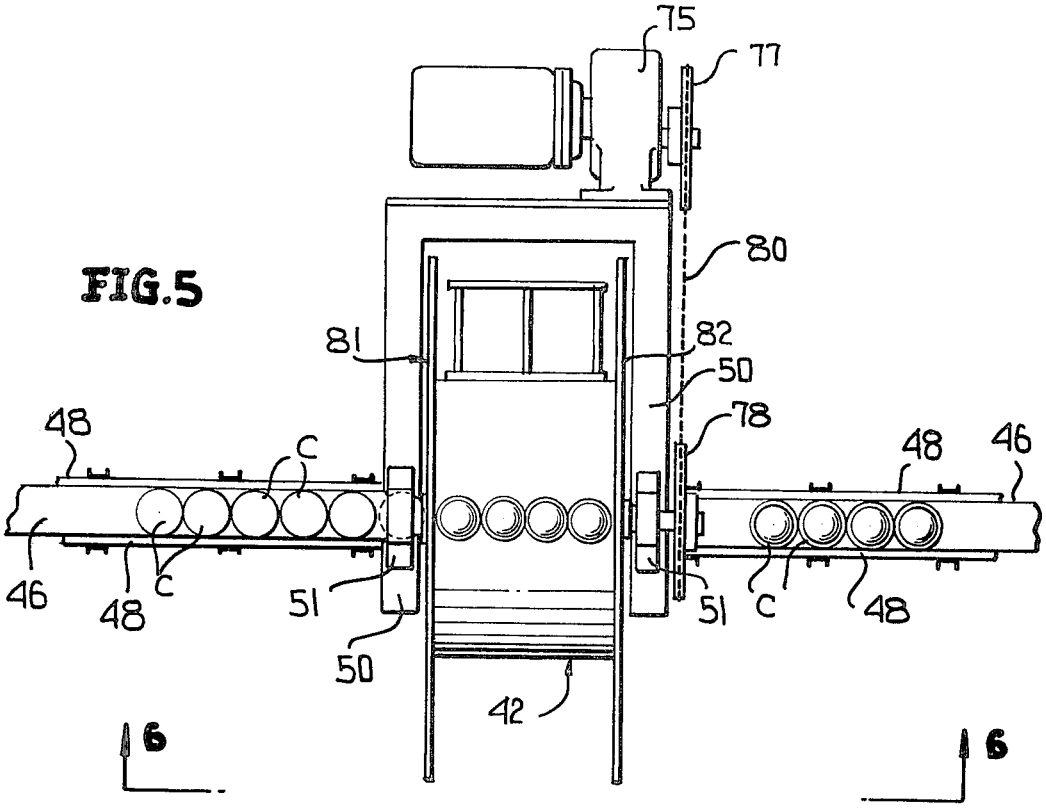
FIG. 5 is a plan view of a preferred form of the filling apparatus, and shows the general details thereof.

Referring most particularly to FIG. 4, it will be seen that the turret 16 in addition to the hub 17 and the stub shafts 18, 19 includes a plurality of plates 20. Certain of the plates 20 are end plates while others of the plates intermediate each pair of adjacent plates 20 are sets of radiating plates 21 arranged in angular relation. Plates of adjacent sets of the plates 21 are disposed in parallel relation and between the adjacent plates 20 define radiating pockets 22. The turret 16 is elongated so that there are a plurality of the pockets 22 and in the illustrated form there are four pockets 22 in each group. Further, as is shown in FIG. 3, each pocket 22 is of a radial extent to receive three tennis balls, i.e. the usual number of balls which are packaged in a single container.

In the illustrated form of the turret 16, there are four groups of pockets 22. The number may vary, but the groups of pockets 22 should be arranged in diametrically opposite paths.

It is to be noted that the turret 16 is completed by arcuate cover plates 23 which extend circumferentially between adjacent groups of pockets 22.

Positioned above the turret 16 is a supply hopper 24 having extending downwardly therefrom a plurality of supply tubes 25 each defining a supply passage 26. It is to be noted that the number of supply tubes 25 corresponds to the number of pockets in a group of pockets in the turret 16.

The dispenser 15 also includes a shield 27 which is of a circumferential extent so as to retain balls within the pockets 22 as the pockets rotate from a ball receiving position to a ball dispensing position.

In order that groups of cans may be positioned beneath the dispenser 15 for receiving balls from the turret 16, there is provided a positioning screw 28. The positioning screw is suitably mounted on the frame 11 alongside and slightly above the endless conveyor belt 13. Opposing the positioning screw 28 is a pair of guard rails 29 which retain the cans C in their upright positions.

The apparatus 10 is driven by means of a suitable power source 30 having an output shaft 31. The shaft 31 is provided with a first pulley 32 which is coupled to a pulley 33 carried by an input shaft 34 of the positioning screw 28 by a belt 35.

The shaft 31 also carries a pulley 36 which is coupled by a belt 37 to a pulley 38 carried by the stub shaft 18 of the turret 16.

Figure 1:
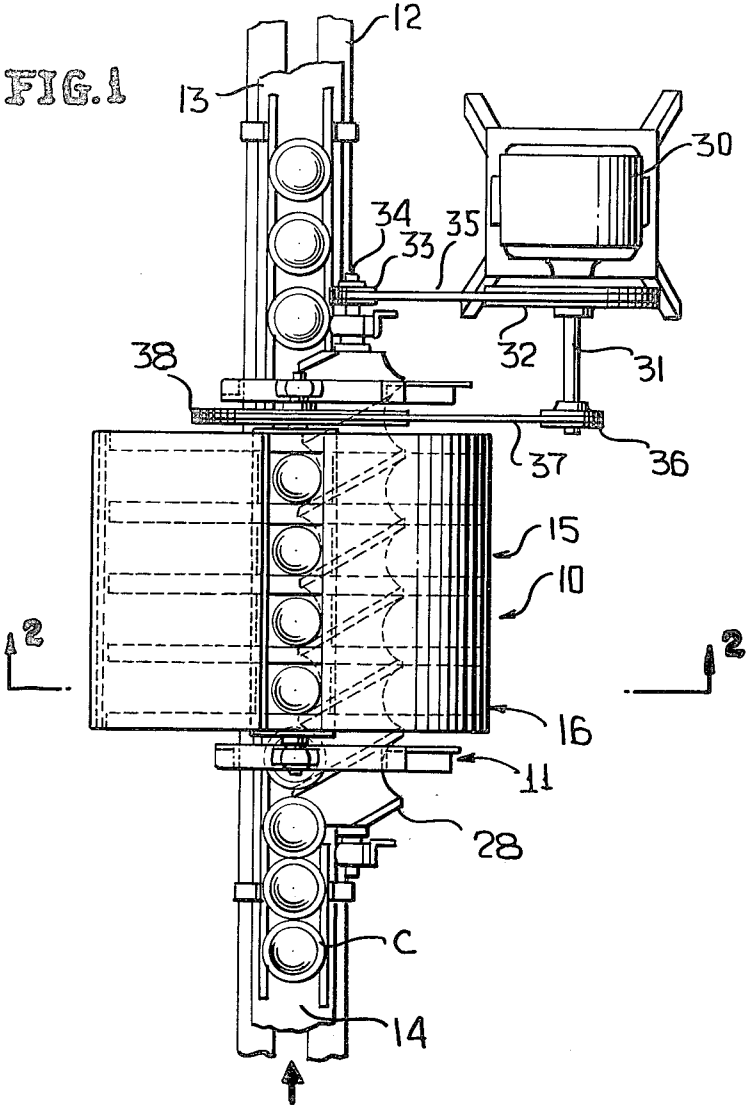
FIG. 1 is a top plan view of one form of the filling apparatus, and shows generally the details thereof.

It is to be understood that the power unit 30 is of the indexing type with the shaft 31 rotating one complete rotation or the like and then stopping each time thereafter at a preset point. The drive ratio between the shaft 31 and the turret 16 on the one hand and the shaft 31 and the positioning screw 28 on the other hand in such that while the turret 16 makes one quarter revolution, the positioning screw 28 will be rotated so as to feed four cans C into position immediately below the turret 16, as shown in FIGS. 1, 2 and 3. Then, while the timer (not shows) or other control device for the power unit 30 times out, the balls within the lowermost pockets 22 will fall by gravity into the underlying cans C. At the same time, balls will fill the uppermost pockets 22 from the supply.

The indexing time should be relatively short and once the indexing time has run, the motor 30 will again operate with the result that the positioning screw 28 will feed the filled cans C out from beneath the turret 16 and move four more new cans beneath the turret 16 for alignment with the next group of pockets 22.

It is to be understood that the construction of the turret 16 may be modified and, in fact, simpler construction envisionable is a plurality of cans C secured to the hub 17 with the cans carried by the hub finding the ball receiving pockets 22.

A preferred embodiment of the filling apparatus is illustrated in FIGS. 5–10 and is generally identified by the numeral 40. The apparatus 40 includes an endless conveyor generally identified by the numeral 41, which delivers cans C to and discharges such cans from the filling apparatus. Extending transversely of the conveyor 41 and in overlying relation thereto is a turret generally identified by the numeral 42.

Figure 6:
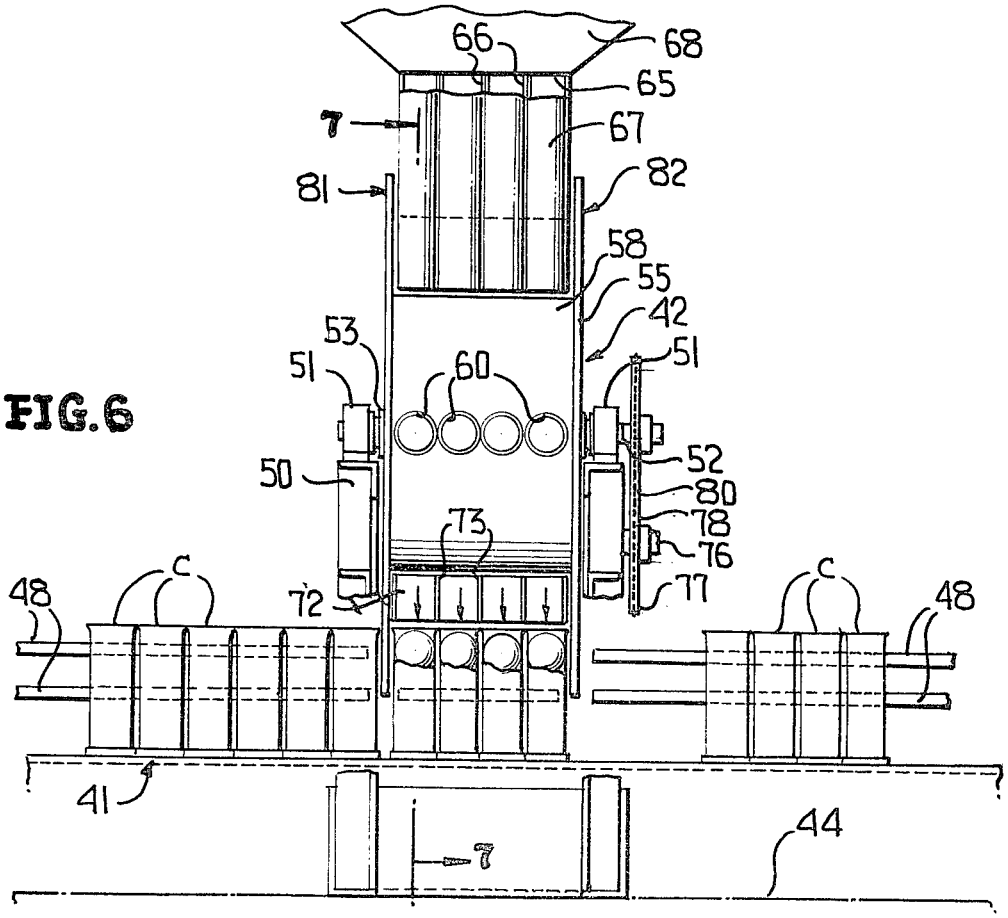
FIG. 6 is a side elevational view of the filling apparatus of FIG. 5, and shows further details thereof.

Referring now to FIG. 6, it will be seen that the filling apparatus 40 is mounted on a base 44. The conveyor 41 is supported from that base in a manner best shown in FIG. 7 wherein it is shown that the conveyor 41 includes a plurality of transversely spaced upstanding supports 45 carried by the base. The supports 45 carry in a suitable manner an endless conveyor member 46 which is illustrated as being in the form of a belt, but may equally as well be in the form of a suitable chain. The endless conveyor member 46 has an upper run positioned for supporting the cans C and the support of the conveyor 41 may include a support bar 47 directly underlying the upper run. It is to be understood that the conveyor member 46 passes around a pair of rotating supports (not shown) one of which is driven. It is to also to be understood that it is preferred that the conveyor member 46 be constantly driven.

The conveyor 41 also includes longitudinally extending guide rails 48 carried by the supports 45 for determining the path of movement of the cans C and retaining the cans on the conveyor member 46 upper run. As is best shown in FIG. 6, the guide rails 48 are interrupted generally in alignment with the turret 42.

The turret 42 is carried by a pair of frame units 50 extending upwardly from the support 44 on opposite sides of the turret. The frame units 50 carry suitable bearings 51 in which there is rotationally journalled a shaft 52 which carries the turret.

The turret 42 specifically includes a hub 53 fixedly carried by the shaft 52 for rotation therewith. Carried by the hub 53 is a pair of spaced end plates 54, 55. Extending between the end plates 54, 55 are radially extending parallel pairs of plates 56 which define radially extending article receiving areas 57. These areas 57 are further divided into individual pockets 58 by further plates 60 which are preferably circular in outline and are carried by the hub 53 in spaced relation axially of the hub 53 as is best shown in FIG. 6. Each pocket 58 is of a size to receive the desired quantity of the product to be dispensed into each can C, and in the illustrated embodiment each pocket 58 is of a size to receive three tennis balls.

Extending around approximately one-half of the turret 42 in the direction of rotation from the top toward the bottom is a combined retainer and guide 61. The combined retainer and guide 61 includes a generally semicircular portion 62 which prevents the outward movement of the tennis balls during rotation of the turret. An entrance guide portion 63 is connected to the upper end of the semicircular portion 62 while a discharge guide portion 64 is connected to the lower end thereof.

It is to be noted that the entrance guide portion 63 is part of a supply chute 65 which overlies the turret 42 and is divided by partitions 66 to define a plurality of supply chutes or passages 67. The supply chute 65 extends downwardly from a supply hopper 68.

The discharge guide has associated therewith a stop plate 70 so as to, in association with the discharge guide 64, define a discharge chute 71 which converges downwardly, the discharge chute 71 being suitably divided into individual chutes 72 by transverse partitions 73 (FIG. 6).

The flared construction of the lower ends of the chutes 67, due to the slope of the guide 63, provides for a wide discharge mouth 74.

The turret 42 is driven by a drive unit 75 which is suitably mounted on the frames 50 and includes a drive shaft 76 (FIG. 6). The drive shaft 76 carries a drive sprocket 77 which is connected to a driven sprocket 78 carried by the shaft 52 by means of a chain 80.

The end plates 54 and 55 carry can positioning vanes 81 and 82, respectively. The vane 81 is an inlet vane while the vane 82 is a discharge vane. As is clearly shown in FIGS. 6 and 7, the vanes 81, 82 extend across the path of the cans C carried by the conveyor 41 and thus control movement of the cans into positions underlying and aligned with the turret 42.

Figure 8:
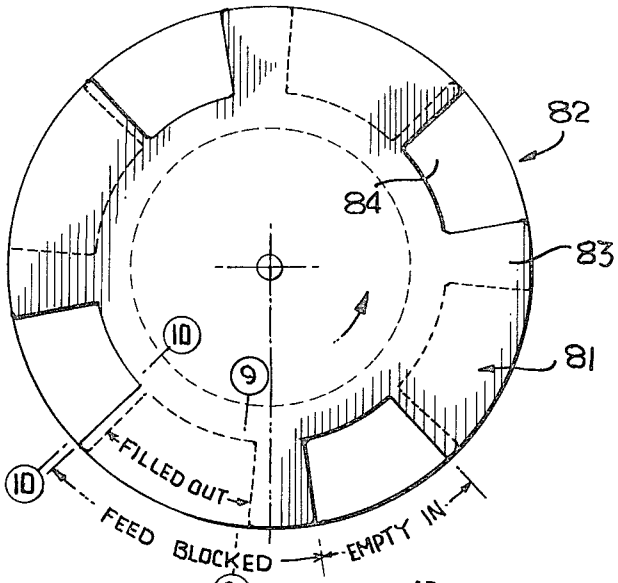
FIG. 8 is a schematic side elevational view showing the relative shapes and positions of two vanes carried by the turret for positioning cans relative to the turret.

Referring now to FIG. 8 wherein the inlet vane 81 is shown in solid lines and the discharge vane 82 is shown in dotted lines, it will be seen that the inlet vane 81 includes a plurality of circumferentially spaced blocking portions 83 which are separated by inlet passages 84. In a like manner, as is most clearly shown in FIG. 7, the discharge vane 82 includes a plurality of circumferentially spaced blocking portions 85 which are separated by discharge openings 86. In FIG. 8 the orientation of the vane 81 with respect to the vane 82 is best shown.

Figure 9:
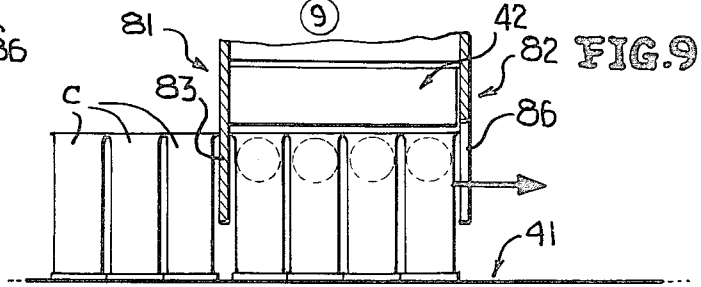
FIG. 9 is a schematic sectional view taken along the line of conveyed cans when the vanes ae in the position of section line 9—9 of FIG. 8 relative to the conveyor.

Referring now to FIG. 9, it will be seen that in one position of the vanes 81, 82 further movement of the cans C by the conveyor 41 into registry with the turret 42 is blocked by a blocking portion 83 while discharge of filled cans from beneath the turret is permitted by the vane 82 having a discharge opening 86 aligned with the conveyor 41. At this time, the turret is rotated slightly clockwise of its position of FIG. 7.

Figure 10:
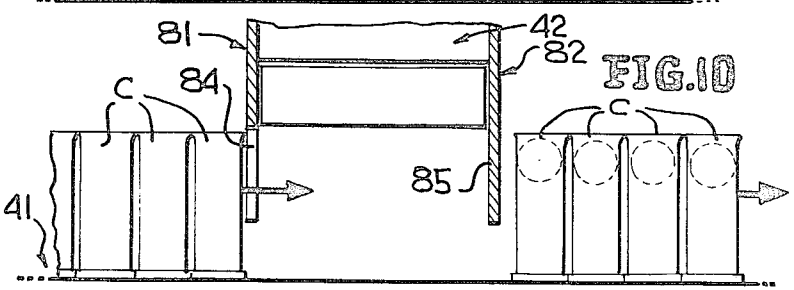
FIG. 10 is a view similar to FIG. 9, showing the vanes in a rotated position with portions of the vanes along line 10—10 of FIG. 8 being aligned with the conveyor.
Figure 7:
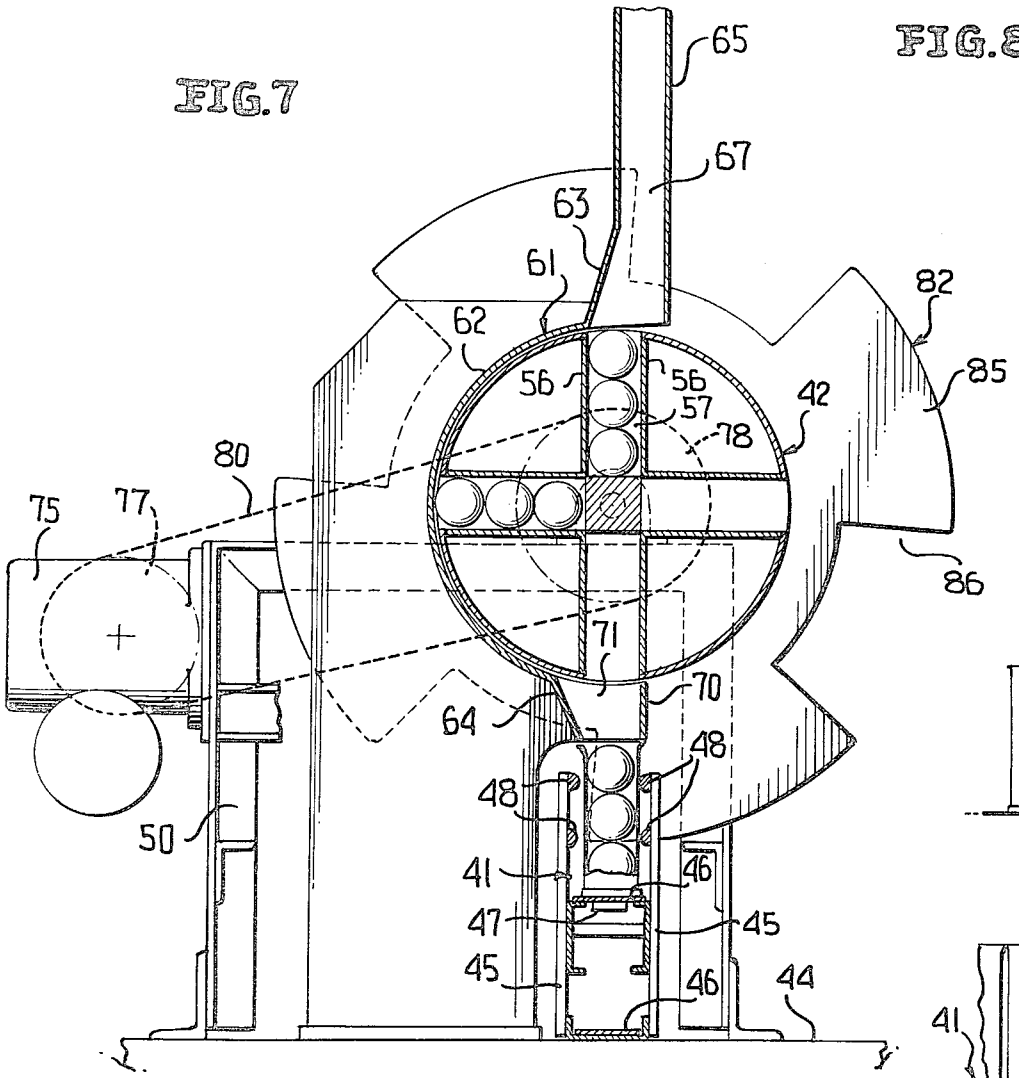
FIG. 7 is a transverse sectional view taken generally along the line 7—7 of FIG. 6, and shows particularly the filling operation.

Referring now to FIG. 10, it will be seen that the turret 42 and the vanes 81, 82 have rotated so that a blocking portion 85 of the vane 82 has now moved to a position to prevent cans from moving along the conveyor 41 past the turret 42 while the vane 81 has rotated to a position where an inlet opening 84 thereof is aligned with the conveyor 41 so as to permit cans C to be moved by the conveyor 41 into alignment with the turret 42. This, of course, is a position intermediate the discharge portions of the turret 42.

It is to be understood that the turret 42 may either be driven at a continuous, but slow, rate or may be indexed. As will be apparent from FIG. 7, the constructions of the guides for the tennis balls will permit a filling of the pockets 57 while the turret is rotating.

It is also pointed out here that it is not necessary that there be an even number of pocket arrangements so that filling of the pockets need not be simultaneous with the discharging thereof.

It will also be apparent that the filling apparatus is suitable to other types of products.

Although only a preferred embodiment of the filling apparatus has been specifically illustrated and described, it is to be understood that minor variations may be made therein without departing from the spirit and scope of the invention as defined by the appended claims.

I claim:

1. A filling apparatus for simultaneously filling plural containers, said apparatus comprising product supply means, dispensing means, and container positioning means, said container positioning means including means for sequentially positioning a series of containers adjacent said dispensing means for individually receiving products from said dispensing means, and said dispensing means including means for receiving products from said product supply and dispensing said products to containers of a positioned series of containers in timed relation to the positioning of such containers, said dispensing means including a turret having plural series of storage areas, and common drive means for said means for sequentially positioning series of containers and said turret.

2. The filling apparatus of claim 1 wherein said common drive means is of the indexing type.

3. A filling apparatus for simultaneously filling plural containers, said apparatus comprising product supply means, dispensing means, and container positioning means, said container positioning means including means for sequentially positioning a series of containers adjacent said dispensing means for individually receiving products from said dispensing means, and said dispensing means including means for receiving products from said product supply and dispensing said products to containers of a positioned series of containers in timed relation to the positioning of such containers, and common drive means for said dispensing means and said means for sequentially positioning series of containers adjacent said dispensing means.

4. The filling apparatus of claim 3 wherein said common drive means is of the indexing type.

5. A filling apparatus for simultaneously filling plural containers, said apparatus comprising product supply means, dispensing means, and container positioning means, said container positioning means including means for sequentially positioning a series of containers adjacent said dispensing means for individually receiving products from said dispensing means, and said dispensing means including means for receiving products from said product supply and dispensing said products to containers of a positioned series of containers in timed relation to the positioning of such containers, said container positioning means including an endless conveyor support for supporting containers while engaged by said means for sequentially positioning said series of containers and for delivering containers to said means for sequentially positioning series of containers, said means for sequentially positioning series of containers being in the form of vanes extending transversely of said conveyor.

6. The filling apparatus of claim 5 wherein said vanes are carries by said dispensing means.

7. A filling apparatus for simultaneously filling plural containers, said apparatus comprising product supply means, dispensing means, and container positioning means, said container positioning means including means for sequentially positioning a series of containers adjacent said dispensing means for individually receiving products from said dispensing means, and said dispensing means including means for receiving products from said product supply and dispensing said products to containers of a positioned series of containers in timed relation to the positioning of such containers, said container positioning means including an endless conveyor support for containers, said dispensing means including a turret overlying said endless conveyor support and being rotational in a plane extending generally transversely of said endless conveyor support, and said means for sequentially positioning series of containers being carried by said turret.

8. The filling apparatus of claim 7 wherein said means for sequentially positioning series of containers being in the form of vanes.

9. The filling apparatus of claim 7 wherein said means for sequentially positioning series of containers being in the form of vanes, said turret having remote sides, and there being an inlet vane on one side of said turret and a discharge vane on the other side of said turret.

10. The filling apparatus of claim 7 wherein said turret has plural series of radiating storage areas, said storage areas being sequentially associated with expanded guide mouths elongated in the direction of turret rotation to facilitate filling and dispensing.

* * * * *